US009074813B2

(12) United States Patent
Staughton

(10) Patent No.: US 9,074,813 B2
(45) Date of Patent: Jul. 7, 2015

(54) AUTOMATED UNLOADING BARE BLOCK PLATE FREEZER SYSTEM

(76) Inventor: Simon Staughton, Howlong (AU)

( * ) Notice: Subject to any disclaimer, the term of this patent is extended or adjusted under 35 U.S.C. 154(b) by 447 days.

(21) Appl. No.: 13/060,014

(22) PCT Filed: Aug. 21, 2009

(86) PCT No.: PCT/AU2009/001068

§ 371 (c)(1),
(2), (4) Date: Feb. 21, 2011

(87) PCT Pub. No.: WO2010/020003

PCT Pub. Date: Feb. 25, 2010

(65) Prior Publication Data

US 2011/0138840 A1 Jun. 16, 2011

(30) Foreign Application Priority Data

Aug. 22, 2008 (AU) ..... 2008904320

(51) Int. Cl.
*F25D 31/00* (2006.01)

(52) U.S. Cl.
CPC ..... *F25D 31/001* (2013.01); *F25D 2400/02* (2013.01)

(58) Field of Classification Search
CPC ..... F25C 1/06; F25C 1/22; F25C 2400/02; A23B 4/06; A23B 4/062; F25D 31/001; F25D 2400/02; A23L 3/362
USPC ..... 62/331, 345, 66, 347, 341, 352; 426/524
See application file for complete search history.

(56) References Cited

U.S. PATENT DOCUMENTS

| | | | | | |
|---|---|---|---|---|---|
| 2,563,093 | A * | 8/1951 | Bayston | 62/135 |
| 3,468,265 | A | 9/1969 | Otken | |
| 3,557,975 | A * | 1/1971 | Amerio | 414/564 |
| 3,771,322 | A * | 11/1973 | Betschart | 62/345 |
| 4,432,214 | A * | 2/1984 | Richelli et al. | 62/341 |
| 4,522,039 | A * | 6/1985 | McNeill | 62/320 |
| 4,593,537 | A * | 6/1986 | Visser | 62/345 |
| 4,651,537 | A * | 3/1987 | Hagen | 62/320 |
| 5,040,383 | A * | 8/1991 | Gram | 62/341 |
| 5,131,241 | A * | 7/1992 | Battistella | 62/341 |
| 5,467,612 | A * | 11/1995 | Venetucci | 62/374 |
| 6,216,472 | B1 * | 4/2001 | Cathenaut et al. | 62/72 |
| 6,261,620 | B1 * | 7/2001 | Leadbeater | 426/515 |
| 6,393,859 | B1 * | 5/2002 | Olsson et al. | 62/345 |
| 2004/0003621 | A1 * | 1/2004 | Zevlakis | 62/352 |
| 2004/0118131 | A1 * | 6/2004 | Standafer | 62/63 |

FOREIGN PATENT DOCUMENTS

| | | | |
|---|---|---|---|
| WO | WO 03/021172 A1 | | 3/2003 |
| WO | WO 03021172 A1 | * | 3/2003 |

* cited by examiner

*Primary Examiner* — Mohammad M Ali
*Assistant Examiner* — Raheena Rehman
(74) *Attorney, Agent, or Firm* — Edwin D. Schindler

(57) ABSTRACT

An automated plate freezer assembly apparatus includes a hopper mounted above at least one freezer plate unit with the hopper able to pass food material from the hopper to the freezer plate unit. The freezer plate unit has a cooling device for freezing the food material and a heating device so that, upon the completion of freezing, frozen blocks of material are able to be gravitationally removed from the plate freezer assembly apparatus.

12 Claims, 2 Drawing Sheets

AUTOMATED UNLOADING BARE BLOCK PLATE FREEZER SYSTEM

AREA OF THE INVENTION

This invention relates to the area of food processing and in particular to an automated plate freezer system that is suitable for all organic products (especially low value bulk products) requiring speedy freezing or chilling with minimal product damage or crushing.

BACKGROUND TO THE INVENTION

Conventional methods of processing food material using freezer plates for such products as red meat pet food offals, fish for pet food, fruit and vegetable pulp, water (block ice) and waste organic product that requires freezing prior to disposal, require a significant degree of human involvement.

Typically, vertically oriented freezer plate assemblies are located on the ground and filled by means of a fork lift and manually leveled. When freezing is completed conventional plate assemblies require their side plates to be pulled out and a ram used to open all blocks at the one time. These blocks then have to be manually lifted out and put on a pallet.

Clearly this process presents occupational health and safety problems as the blocks may be slippery and difficult to handle. Additionally there is a limit to the weight that a human can be expected to handle in this manner.

OUTLINE OF THE INVENTION

It is an object of this invention to provide a food processing system which minimises human involvement compared with previous systems.

In the invention the term food material includes both solid and fluid material as well as water.

The invention is an automatic plate freezer assembly system, said assembly system including a hopper mounted above at least one freezer plate unit, said hopper adapted to pass food material from the hopper to the freezer plate unit, said freezer plate unit being provided with cooling means to freeze the food material and heating means such that, on the completion of freezing, frozen blocks of material are able to be gravitationally removed from the plate freezer assembly.

It is preferred that a plurality of freezer plate units be combined in the plate freezer assembly.

It is further preferred that the plate freezer assembly include a plurality of freezer plates to form a bank of such plates said assembly being provided with opening and closing means and mounted in a mainframe.

It is also preferred that the opening and closing means be effected using draw bolts linking the plates to pneumatic rams at either end of the bank of plates.

It is preferred that the freezer plates be provided with a refrigeration system which has a hot gas circuit as well as a freezer circuit, It is also preferred that the plate freezer assembly have at least one bottom floor plate which is plumbed to the hot gas circuit of the refrigeration system.

It is further preferred that the floor consist of two floor plates each half the length of the bank of vertical plates and the same width.

It is preferred that these floors be mounted on frames which sit on side rails attached to the main frame of the plate freezer assembly.

It is further preferred that the slide rails be pneumatically raised and lowered by means of an internal air bag which when inflated raises the floors to at least the base of the freezer plate assembly and seals its base.

It is also preferred that a floor ram be provided such that when the plate freezer assembly is open the floors can be moved to pre determined sensor positions to permit the sequential removal of blocks of frozen food material to a conveyer belt below.

It is preferred that a pressure pump be used to move food material to a storage barrel or hopper which is in turn mounted above the plate freezer assembly.

It is also preferred that the hopper/barrel when closed is a storage vessel holding sufficient food material to fill the plate freezer assembly.

It is further preferred that when rotated it is able to tip its contents into the plate freezer assembly.

In order that the invention may be more readily understood we will described by way of non limiting example a specific embodiment of the components of the automated food freezing system with reference to the accompanying drawings.

BRIEF DESCRIPTION OF THE DRAWING FIGURES

DESCRIPTION OF AN EMBODIMENT OF THE INVENTION

The invention is an automated plate freezer system 100 that is suitable for all organic products requiring freezing or chilling with minimal product damage or crushing. The plate freezer cavities are designed to be watertight without prior freezing. Products suitable for freezing or chilling in this system include pet food offals, human consumption bulk meat products, fish for human consumption or pet food, fruit and vegetable pulp, water (block ice), dairy products and other liquid organic products, waste organic products that require freezing prior to disposal.

Figure 1:
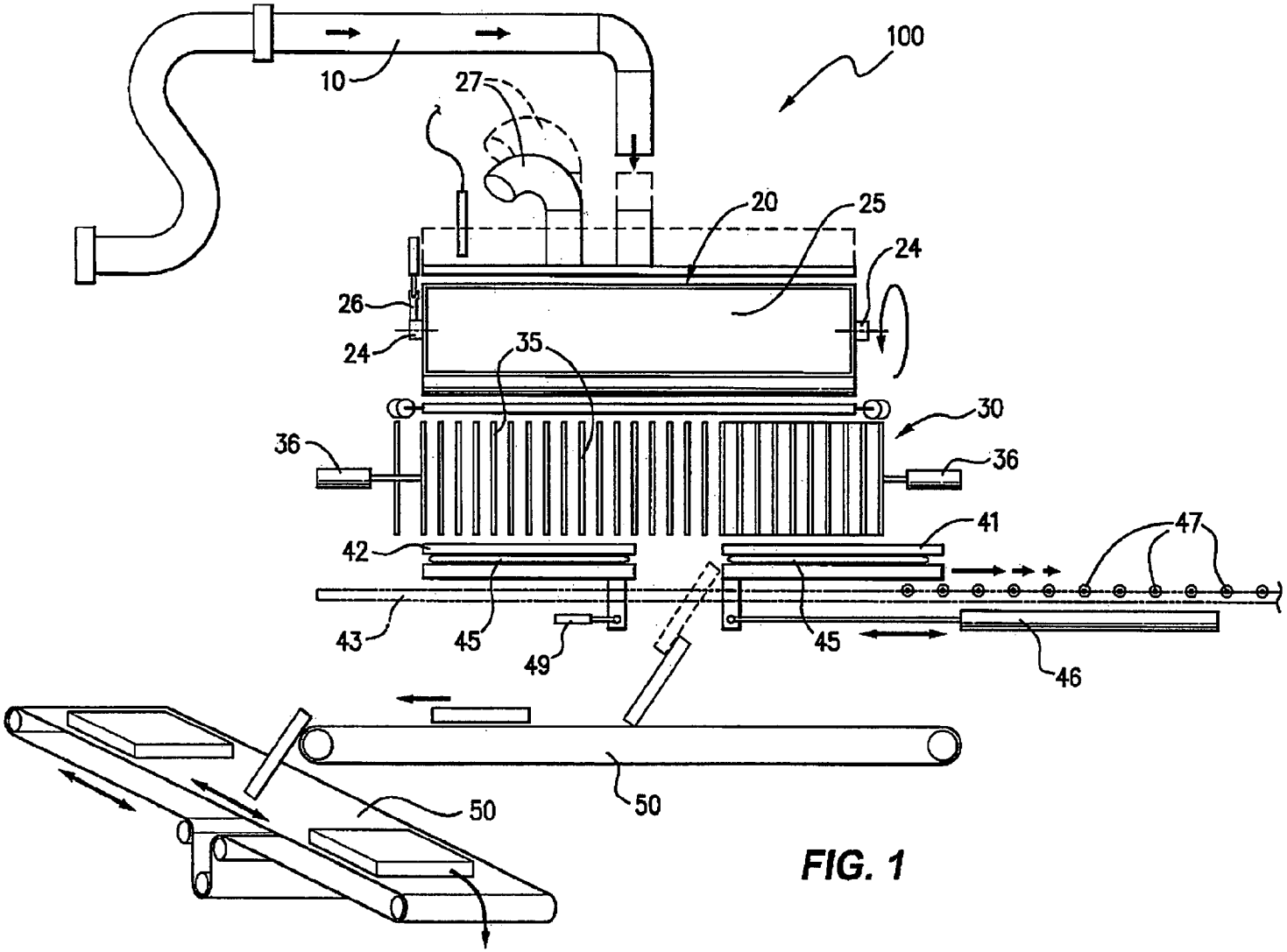
FIG. 1 Shows a schematic diagram of the plate freezer assembly system of the invention.
Figure 2:
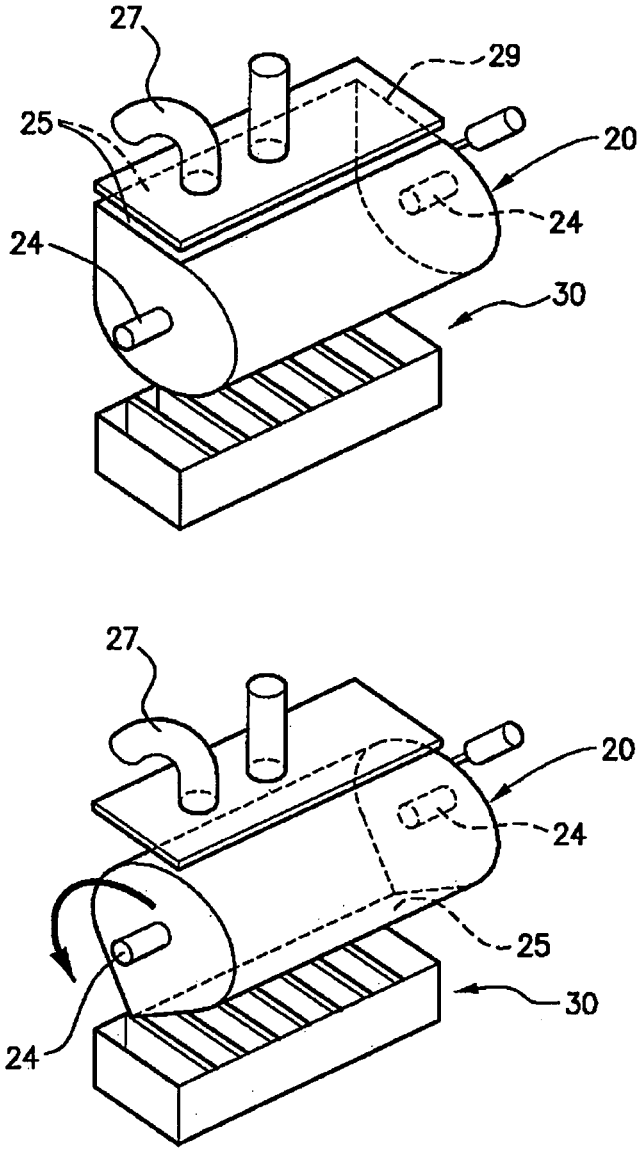
FIG. 2 Shows detail of the hopper barrel used for filling the plate freezer assembly.

As shown in FIG. 1 a pressure pump delivers food material through delivery tube 10 to a hopper, which in this embodiment of the invention is a barrel 20, which is mounted on a frame above the plate freezer assembly 30 and, when closed, acts as a capture chamber for product delivered under pressure from the pump.

It then becomes a storage vessel, holding a measured charge of product, for filling the plate freezer assembly 30. On rotation, controlled by the operator, it tips the stored product into the plate freezer cavities.

The hopper is a stainless steel barrel of the same length as the plate freezer and with a diameter (approx. 1 meter) that allows a holding capacity 10% in excess of the capacity of the plate freezer unit. An opening 25 which is 350 mm wide runs the length of the barrel.

The barrel is mounted on a frame above the plate freezer cavities via two bearings 24 in the centre of each end. An hydraulically operated crank 26 is used to rotate the barrel. A "door", corresponding in dimension with the barrel opening, is fixed on the frame above the barrel. An overflow outlet 27 is located In the "door".

The barrel contains a cable earth set at the required position, so that it can register when the barrel has received precisely the amount required to fill the plate freezer while the bottom of the barrel has a 2 mm slot (not shown) running along its length to allow drainage.

During filling the barrel is rotated so that the opening is positively located against a fixed "door" 29 mounted on the barrel frame above the barrel. Other than the overflow outlet, this effectively ensures the barrel is sealed during filling. The barrel is filled during the freeze cycle of the plate freezer. Filling is automatically stopped when incoming product reaches a level sensor. Product overflows through the overflow outlet 27 in the event of sensor failure. The barrel has a proximity switch which only allows filling when the barrel is fully dosed and sealed against the "door".

To empty the barrel, the operator activates the hydraulic crank to roll the barrel away from the "door" allowing stored contents to flow out and into the plate freezer. Flow rate is controlled by the operator via the amount of rotation of the barrel.

For cleaning, the barrel can be rotated to the emptying position so that its internal surface can be foamed and pressure hosed through the opening or a cleaning in place system.

As the system is fully openable it can be thoroughly cleaned with no inaccessible surfaces or other locations.

The plate freezer assembly is located directly below the filling barrel and above an unloading or "harvest" conveyor 50. The unit comprises a number of conventional aluminum vertical freezer plates 35 which in this embodiment of the invention are 760 mm high and 1050 mm long. The plates are mounted conventionally in a stainless steel frame. The plates are spaced 100 mm apart when closed and 115 mm apart when open. (The number and dimension of plates is dependant on the required capacity of the plate freezer unit and they are mounted as in conventional vertical plate freezers).

All the vertical plates are linked via draw bolts to pneumatic rams 36 at either end of the bank of plates, Pneumatic rams (in preference to hydraulic) are used to avoid damage to the aluminum plates in the event of a block jamming during unloading or if an operator tries to open and unload the plates before they have been properly defrosted.

The plates are located between side rails and each plate is provided with a locating lug which positions the next adjacent plate..

The bottom floor of the unit is made of two sections of plate freezer aluminum section, being rear floor plate 41 and second floor plate 42. The floors are each half the length of the bank of vertical plates and the same width. The floor plates are plumbed to the hot gas circuit of the refrigeration system via flexible stainless steel braided hoses.

The bottom of each plate is insulated to avoid condensation falling under the floor and potentially contaminating discharge product, any appropriate insulation may be used or a second floor may be deployed.

The aluminum floors are mounted on steel frames 43, which sit on slide rails attached to the main frame of the plate freezer unit. The slide rails extend past the end of the bank of freezer plates far enough to allow the rear floor to fully open.

Polypropylene pads between the floor frames and the slide rails allow the floors to slide backwards and forwards easily.

The slide rails can be pneumatically raised and lowered via an internal air bag 45, comprising a length of 50 mm "lay-flat" hose located within the 100 mm slide rail on a lift platform within the slide rail. The lift platform is fixed to the main superstructure and the 100 mm slide rail has 25 mm of movement, up and down. When down (air bag deflated), there is a clearance of 20 mm between the top surface of the floor plate and the bottom of the vertical plates. When raised (air bag inflated) the floor plate contacts the bottom of the vertical plates and lifts them 5 mm, creating a positively sealed cavity.

A single hydraulic ram 46 is attached to the rear floor and to the end of the slide frame. The ram is the same length as each floor. Active sensor points 47 are located on the frame of the rear floor to correspond with a limit switch located on the frame. The spacing of the sensor points is the same as the spacing of the vertical plates when opened, i.e. 115 mm. Locking lugs between the front floor and the back floor allow the two floor sections to be linked when required. The lugs are operated by a small hydraulic ram 49 although pneumatic may be used.

A harvest conveyor 50 is mounted below the bank of vertical plates. The conveyor is the same width as the vertical plates. The distance from the conveyor to the bottom of the vertical plates is the same as the height of the plates.

It is envisaged that a slide ramp can be located on the front of each floor to deflect the bottom of a falling block toward the delivery end of the conveyor. The angle of the ramp can be pneumatically controlled to control the rate of fall of the block.

To fill the plate freezer assembly the vertical plates are clamped dosed by the two end pneumatic rams 36. The front and back floors are closed and the airbags in the side slide rails of the horizontal floor plates are raised to seal the bottom of all plate cavities.

The barrel is then rotated by the operator and the operator manually levels product in the plate cavities when the barrel has been emptied or the operator uses an injection nozzle connected to the pump output to fill and level each plate cavity individually. After filling the freeze/chill cycle is initiated by the operator.

On completion of the freeze/chill cycle the vertical plates are defrosted with hot gas as are the floors. The air bags are deflated allowing the floor plates to drop away from the vertical plates. The vertical plates are then opened by the two end rams and the draw bolts. These operations are under PLC control.

The temperature of the defrosted plates (in which the frozen blocks sit while waiting to be dropped) is controlled precisely so that blocks do not re-freeze to the plates and do not thaw excessively, Using a PLC the floor ram is instructed to open to the first sensor point then stop. This move allows the first block to drop onto the harvest conveyor. After a set time the ram is programmed to move to the next sensor point allowing another block to fall, and so on.

After the rear section of plates has been emptied, the ram returns the rear floor to the closed position. The PLC then instructs the small lug ram to look the lugs to hold the two floors together.

The opening sequence is then repeated—the rear floor moving back with the front floor attached, allowing the front blocks to sequentially drop onto the harvest conveyor.

After the front section of plates has been emptied both plates are returned to the closed position. The vertical plates are then closed, the floor raised and the unit is ready for the next filling.

The harvest conveyor delivers blocks to the front of the plate freezer unit. If mare than one plate freezer unit is incorporated in the system, a common, main conveyor 55 receives the blocks from the harvest conveyor of each unit.

To clean the unit the floors are dropped, creating a 20 mm gap which allows wash water and any residue on the vertical plates to easily escape.

A main conveyer is located along the front of the plate freezer units where more than one is installed, If the plate freezers are required to carry out two functions, that is either chill product for grinding into a bulk mince, or to freeze product for palletising, this conveyor can be bi-directional.

Blocks of frozen food material can pass by conveyer to a block sizing and palletising station and then to a wrapping weighing and identification.

The invention provides a plate freezer system which freezes to a specified temperature of minus 20° C. from plus 20° C. within 4 hours. Alternatively it chills to a specified temperature—minus 0.05° C. from plus 20° C. within 30 minutes to produce a bulk 5 mm ground product with a shelf life double that of the same product chilled conventionally to plus 4° C. Depending on immediate history, shelf life of fresh meat at 20° C. would have a shelf life at minus 0.05° C. in excess of 300 hours.

Advantages of the system are that it does not require dividers to size blocks and does not require manual labour. It does not require forklifts or fork lift access to fill/empty plates.

The invention produces bare blocks that can be automatically sized to any required block size without using dividers in the freeze cavity.

It produces pallets of bare blocks that do not require individual blocks to be boxed thus saving the cost of boxes and plastic liner bags.

It produces pallets of frozen blocks that take up ⅔ the space of the equivalent weight of material in boxed frozen pallets, reducing by ⅔ the cost of storage and transport. ie. 3 pallets of bare blocks will take up the same space as 2 pallets of equivalent of boxed product. Additionally an individual pallet of bare blocks will not only take up ⅔ the space of an individual pallet of boxed, but will weigh 10% more.

There is also no manual lifting of individual blocks and no possibility of dividers contaminating product. With conventional bare block vertical plate freezers, dividers are inserted into individual plate cavities during filling to divide cavity into. blocks. Dividers are manually removed from the frozen blocks during palletising .

The invention eliminates OH&S issues associated with conventional freezing systems, either blast freezing or especially from conventional vertical plate freezers.

A "Super" block can be created by filling a 1 cubic meter mould with the chilled product. The filled mould can be then stored in a conventional freezer store (no need for a blast freezer) over 3-4 days to allow complete freezing of the block. There is no shelf life loss of the internal part of the block because it has been chilled to below zero. This system would require significantly less residence time (approximately one third) in the plate freezers to produce fully frozen product and therefore less capital expenditure on freezing equipment. A freezer store is necessary, but Is required in any case to store frozen pallets of blocks. The blocks could only be used by an end user with appropriate equipment.

The invention is not restricted in terms of construction materials used although it is preferred that aluminum be used for manufacture of freezer plates used in production of pet food or non human consumption products. For production of human consumption bare blocks, the aluminum plates used in the plate freezers can either be replaced with plates manufactured from stainless steel or the aluminum can be coated with 3 coats, the number unrestricted in the invention, of food grade epoxy resin, specified for the temperature ranges required. The individual coats of epoxy would be of different colours so that any damage/wear to the outer coats would be easily identified and repaired before inner layers (or aluminum surface) were exposed. Teflon coating could also be used.

While we have described, herein one specific embodiment of the invention it is to be understood that variations in and modifications in the features described may be made without departing from the scope of the invention.

The claims defining the invention are as follows:

1. An automated plate freezer assembly apparatus, comprising:

a freezer plate unit having a plurality of plates defining a plurality of freezer cavities, each plate of said plurality of plates being selectively connectable to a cooling device and a heating device;

a hopper mounted above said freezer plate unit for receiving food material therein for delivery into the plurality of freezer cavities of said freezer plate unit; and, a floor beneath said freezer plate unit and movable between a first position, wherein said floor is raised for sealing a base of each of the plurality of freezer cavities of said freezer plate unit, and a second position, wherein said floor is movable horizontal for forming an opening for facilitating delivery of frozen food material from at least one freezer cavity of the plurality of freezer cavities through said floor to a conveyor located beneath said floor, wherein, by connecting each said plate of said plurality of plates to the cooling device, the food material present in the plurality of freezer cavities is able to be frozen and by connecting each said plate of said plurality of plates to the heating device, the frozen food material is able to freefall via gravity from at least one said freezer cavity, through said opening formed in said floor and onto the conveyor for facilitating removal of the frozen food material from said automated plate freezer assembly apparatus.

2. The automated plate freezer assembly apparatus according to claim 1, wherein said plurality of plates are combined in bank and mounted in a mainframe for forming at least one said freezer plate unit.

3. The automated plate freezer assembly apparatus according to claim 2, wherein at least one said freezer plate unit includes means for opening and means for closing.

4. The automated plate freezer assembly apparatus according to claim 3, wherein said means for opening and means for closing are effected via draw bolts linking said plurality of plates to pneumatic rams at an end of said bank of said plurality of plates.

5. The automated plate freezer assembly apparatus according to claim 1, wherein said floor is plumbed to the heating device.

6. The automated plate freezer assembly apparatus according to claim 5, wherein said floor includes two floor plates, each floor plate of said two floor plates being configured for extending half a length of said freezer plate unit and having a width equal to that of said freezer plate unit.

7. The automated plate freezer assembly apparatus according to claim 6, wherein each said floor plate mounted on a frame with the frame being supported on slide rails attached to a main frame of said freezer plate unit.

8. The automated plate freezer assembly apparatus according to claim 7, wherein said slide rails are pneumatically raised and lowered via an internal air bag which, when inflated, raises said floor plates to, at least, a base of said freezer plate unit for sealing each freezer cavity of said freezer plate unit.

9. The automated plate freezer assembly apparatus according to claim 8, further comprising a floor ram, so that when said floor is in the second position, said floor plates are movable to positions predetermined by a sensor for permitting sequential removal of the frozen food material to the conveyor below.

10. The automated plate freezer assembly apparatus according to claim 1, further comprising a pressure pump for moving the food material to said hopper.

11. The automated plate freezer assembly apparatus according to claim 1, wherein said hopper has a barrel shape that is closable for storing food material sufficient for filling the freezer cavities of said freezer plate unit.

12. The automated plate freezer assembly apparatus according to claim 11, further comprising means for rotating said hopper for causing the food material stored in said hopper to be delivered into the freezer cavities of said freezer plate unit.

* * * * *